US010392734B2

(12) United States Patent
Hsu

(10) Patent No.: US 10,392,734 B2
(45) Date of Patent: Aug. 27, 2019

(54) YARN TENSION CONTROL DEVICE

(71) Applicant: Tzu-Chin Hsu, New Taipei (TW)

(72) Inventor: Tzu-Chin Hsu, New Taipei (TW)

( * ) Notice: Subject to any disclaimer, the term of this patent is extended or adjusted under 35 U.S.C. 154(b) by 172 days.

(21) Appl. No.: 15/634,187

(22) Filed: Jun. 27, 2017

(65) Prior Publication Data

US 2018/0002845 A1 Jan. 4, 2018

Related U.S. Application Data

(60) Provisional application No. 62/358,047, filed on Jul. 3, 2016.

(51) Int. Cl.

| | |
|---|---|
| ***D04B 27/18*** | (2006.01) |
| ***D04B 27/14*** | (2006.01) |
| ***D04B 27/16*** | (2006.01) |
| ***D04B 27/24*** | (2006.01) |

(52) U.S. Cl.

CPC ..... *D04B 27/18* (2013.01); *D04B 27/14* (2013.01); *D04B 27/16* (2013.01); *D04B 27/24* (2013.01)

(58) Field of Classification Search

CPC ..... D04B 27/16; D04B 27/18; D04B 27/20; D04B 27/22

See application file for complete search history.

(56) References Cited

U.S. PATENT DOCUMENTS

| | | | | | |
|---|---|---|---|---|---|
| 2,395,807 | A * | 3/1946 | Florentino | D04B 27/00 | 66/212 |
| 2,400,526 | A * | 5/1946 | Amidon | D04B 27/20 | 66/212 |
| 2,476,274 | A * | 7/1949 | Elmore | D03D 49/08 | 242/421.2 |
| 2,823,530 | A * | 2/1958 | Rikard | D02H 13/28 | 139/101 |
| 3,648,459 | A * | 3/1972 | Furst | D04B 23/12 | 66/84 R |
| 3,899,900 | A * | 8/1975 | Jackson | D04B 21/18 | 66/177 |
| 4,736,602 | A * | 4/1988 | Denzler | D04B 27/22 | 66/210 |
| 5,058,398 | A * | 10/1991 | Memminger | D04B 15/38 | 66/132 R |
| 5,152,158 | A * | 10/1992 | Wirth | D04B 27/22 | 33/734 |
| 5,163,307 | A * | 11/1992 | Jahn | D04B 27/22 | 139/105 |
| 5,176,010 | A * | 1/1993 | Wirth | D04B 27/22 | 139/107 |

(Continued)

*Primary Examiner* — Danny Worrell
(74) *Attorney, Agent, or Firm* — Rosenberg, Klein & Lee

(57) ABSTRACT

A yarn tension control device of knitting machines is revealed. A plurality of yarn tension control devices is disposed on a knitting machine for control of warp yarns while weaving the warp yarns to produce fabrics. The warp yarns can be metal yarns. The metal yarns on a yarn disc are passed through a guide holder, bars for drop wires, and drop wires and then entered steel healds and reeds. Thus a constant yarn tension over the warp yarns is ensured by the yarn tension control devices during a weaving process of weft yarns. The tension of the metal yarns is the same with the tension of textile yarns. Thereby a stable yarn tension over the warp yarns gives uniform fabric appearance.

12 Claims, 14 Drawing Sheets

(56) References Cited

U.S. PATENT DOCUMENTS

| | | | | |
|---|---|---|---|---|
| 5,524,461 | A * | 6/1996 | Nielsen | D04B 27/22 139/105 |
| 5,921,111 | A * | 7/1999 | Maier | D04B 23/02 66/87 |
| 2018/0002845 | A1 * | 1/2018 | Hsu | D04B 27/14 |

* cited by examiner

YARN TENSION CONTROL DEVICE

BACKGROUND OF THE INVENTION

Field of the Invention

The present invention relates to a yarn tension control device, especially to a yarn tension control device used on a knitting machine for controlling tension of different warp yarns and providing a constant tension over the warp yarns on the knitting machine. Thus a stable yarn tension over the warp yarns gives uniform fabric appearance.

Description of Related Art

Generally, yarns used on a warp beam of a knitting machine including rapier loom are textile yarns. After the textile yarns being passed through bars for drop wires, and drop wires and then entered steel healds and reeds, their tension is easily controlled within a certain range. During knitting of weft yarns, a constant tension over the warp yarns is required in the conventional textile technology.

Refer to FIG. 1 and FIG. 2, a conventional rapier loom is revealed. Yarns on a warp beam 10 are textile yarns. After passed through a guide holder 91, a back rest sensing roller 92, bars for drop wires 93, drop wires 94 and entered steel healds 95, the tension of the yarns is easily controlled within a certain range. During weaving of weft yarns after passage of reeds 96, a constant yarn tension over the warp yarns is ensured. After the weaving of the wefts on the warps, fabric formed by the textile yarns is drawn by a cloth roller 100. In the conventional rapier loom, only common fabric can be drawn and produced because that a constant yarn tension over the yarns is required.

Once metal yarns and textile yarns with different tensions are fed into the conventional knitting machine (including the rapier loom) and wound around the warp beam, warping is getting difficult. Besides increasing difficulty in warping, the different tensions of the metal yarns and the textile yarns from the yarn disc to the knitting machine for being woven lead to unstable yarn tension over the warp yarns. Thus the appearance of the fabric produced is uneven.

Thus there is room for improvement and there is a need to provide a novel yarn tension control device that solves the problems mentioned above.

SUMMARY OF THE INVENTION

Therefore it is a primary object of the present invention to provide a yarn tension control device that is applied to knitting machines for providing a constant yarn tension over different warp yarns on the knitting machine. Thus uniform fabric appearance is given by a stable yarn tension over the warp yarns during weaving.

In order to achieve the above object, a yarn tension control device according to the present invention includes a main support, a yarn disc disposed on one side of the main support, a clamp support arranged at the other side of the main support, a rotary disc located in the clamp support, a rubber set disposed on the clamp support for control of rotational speed of the rotary disc, and a rotatable clamping roller connected to the main support. The knitting machine is arranged with a plurality of yarn tension control devices for control of metal yarns while weaving warp yarns to produce fabrics. The metal yarns on the yarn disc are passed through a guide holder, bars for drop wires, and drop wires and then entered steel healds and reeds. Thus a constant yarn tension over each warp yarn is ensured by the respective yarn tension control devices while knitting weft yarns. Therefore uniform fabric appearance is provided by a stable yarn tension over the warp yarns during the weaving process.

An adjustment switch is arranged at the clamp support. The adjustment switch consists of a rod that is passed through an opening of the clamp support, a spring fit around the rod, and a knob fastened on a rear end of the rod for adjustment of an opening distance of the clamp support.

The metal yarns or textile yarns are fixed on the yarn disc after warping so that the yarn tension control device is independent of the warp beam. The yarn tension control device is used to adjust and control a tension of the metal yarn or the textile yarn from the yarn disc. Thus a stable fabric take-off speed is reached according to the tension of the warp yarns on the warp beam, the running speed of the knitting machine and the fabric weft density so as to produce fabric with certain weft density. Therefore the appearance of the fabric produced is uniform.

The yarn tension control device can be applied to knitting machines while producing special fabrics including conductive heating fabric, electromagnetic shielding fabric, radar absorbent fabric, etc. for control of tension of metal yarns or textile yarns in warp yarns therein. A plurality of yarn tension control devices is used while producing fabric.

The yarns tension control device is used during weaving of fabric formed by textile yarns. A plurality of metal yarns is woven on edges of two sides of the fabric surface. The metal yarns can be conductive metal yarns or non-conductive metal yarns.

The yarns tension control device is used during weaving of fabric formed by textile yarns. The fabric produced by textile yarns includes a plurality of textile yarns woven on edges of two sides of the fabric surface used as scrap yarns during knitting.

The clamping roller is connected to one end of the connecting rod and a bearing is mounted in the clamping roller so as to make the clamping roller rotatable and able to press against the yarns on the yarn disc. The yarns can be metal yarns or textile yarns.

In order to achieve the above object, a yarn tension control device according to the present invention includes a main support, a yarn disc and a rotary disc that are disposed on one side of the main support, a support fixing member arranged at one side of the rotary disc, an adjusting rod set moveable in the support fixing member, a belt mounted around the rotary disc for control of rotational speed of the rotary disc, and a rotatable a clamping roller connected to the main support. A plurality of yarn tension control devices is used for control of warp yarns respectively while weaving the warp yarns to produce fabrics. The warp yarns can be metal yarns. The metal yarns on the yarn disc are passed through a guide holder, bars for drop wires, and drop wires and then entered steel healds and reeds. Thus a constant yarn tension over the warp yarns is ensured by the yarn tension control devices during a weaving process of weft yarns. The tension of the metal yarns is the same with the tension of the textile yarns. Thereby a stable yarn tension over the warp yarns gives uniform fabric appearance.

The adjusting rod set consists of an adjusting bolt and a locking nut. The adjusting bolt is passed through and moveable in a guide slot while the locking nut is fastened on the adjusting bolt and used for positioning the adjusting bolt in the guide slot.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
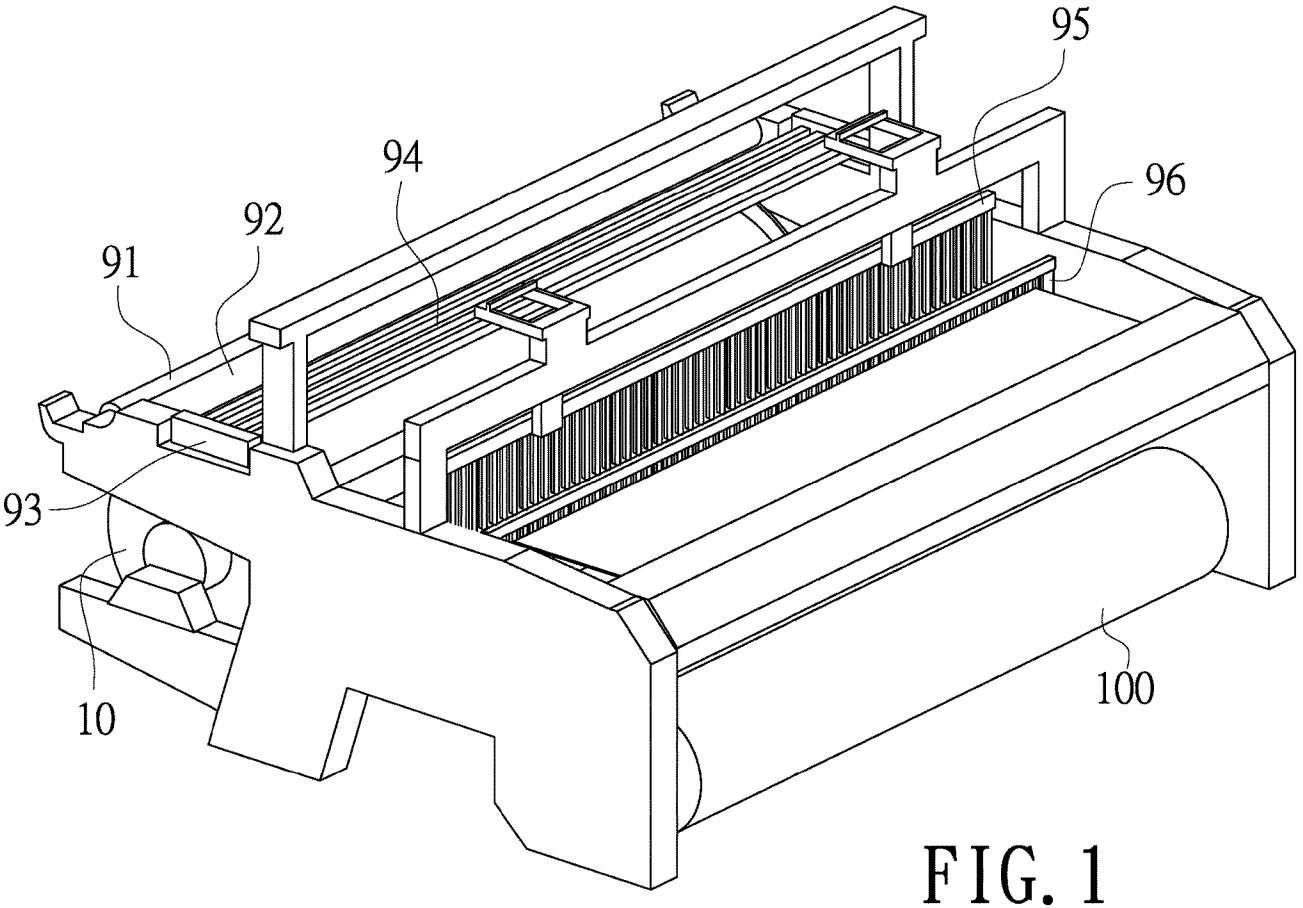
FIG. 1 (PRIOR ART)
FIG. 1 is a partial schematic drawing of a conventional rapier loom with a cloth roller.
Figure 2:
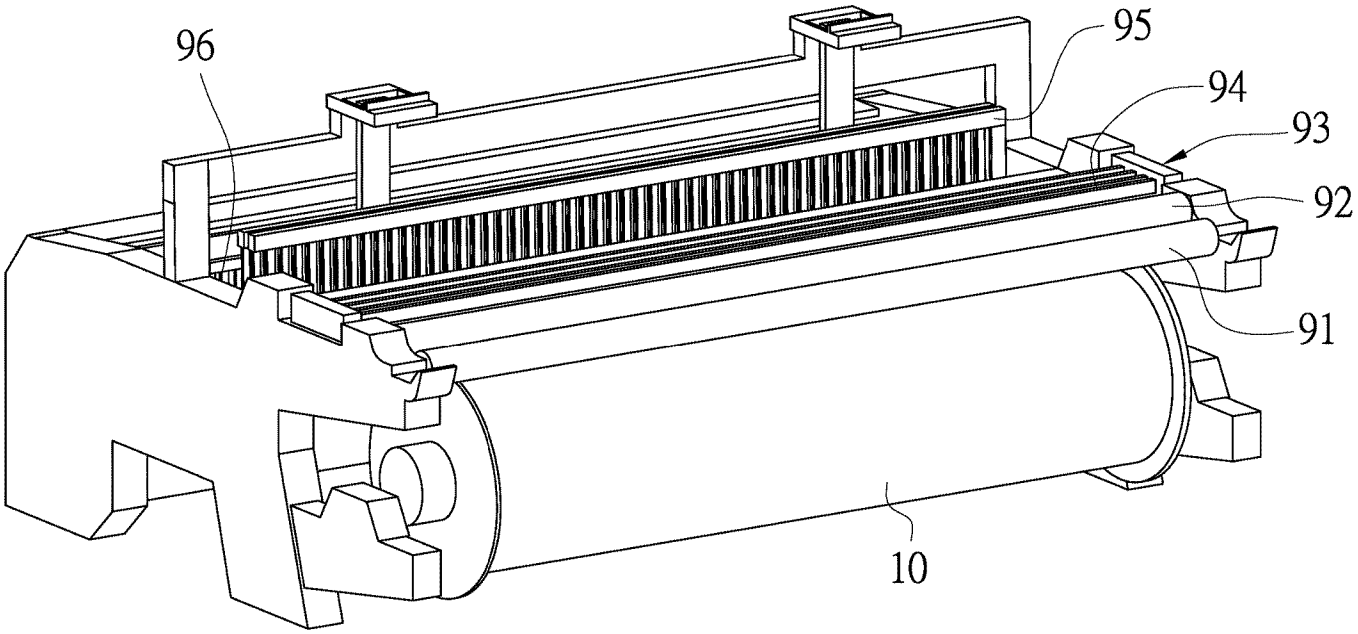
FIG. 2 (PRIOR ART)
FIG. 2 is a partial schematic drawing of a conventional rapier loom with a warp beam.

In order to learn technical content, purposes and functions of the present invention, please refer to the following embodiments, related figures and reference numbers.

Refer from FIG. 1 to FIG. 5, a plurality of yarn tension control devices 2 according to the present invention is disposed over a knitting machine 1 while in use.

The yarn tension control device 2 includes a main support 21 set over the knitting machine 1. A main shaft 211 is passed through the main support 21 and is arranged with a yarn disc 22 and a rotary disc 25. The yarn disc 22 is wound with yarns. A rotatable clamping roller 27 is disposed on the main support 21 and is used for pressing against the yarns of the yarn disc 22. The yarn disc 22 and the rotary 25 are rotated at the same speed along with the yarns being drawn by an external force. A friction damper B is set on one side of the rotary disc 25 correspondingly and is used to control and adjust rotational speed of the rotary disc 25.

While in use, the friction damper B in the yarn tension control device 2 can adjust and control the rotational speed of the rotary disc by frictional resistance, tightness of the belt or arrangement of the electric brake system.

Refer to FIG. 5, FIG. 6, FIG. 7 and FIG. 8, a yarn tension control device 2 according to the present invention is composed of a main support 21, a yarn disc 22, a clamp support 23, a rotary disc 25, a rubber set 26 and a rotatable clamping roller 27.

The main support 21 is a base installed over the knitting machine 1. A main shaft 211 and a connecting rod 212 are passed through and arranged at the main support 21 while a fixing base 213 is disposed on one end of the main shaft 211.

The yarn disc 22 is fit on the fixing base 213 and is wound with yarns (including metal yarns 4 or textile yarns 5). The yarns are used for warp knitting.

The clamp support 23 is disposed on one end of the connecting rod 212 and an adjustment switch 24 is arranged at a rear end of an opening of the clamp support 23.

The rotary disc 25 is connected to the other end of the main shaft 211 and located in the opening of the clamp support 23.

The rubber set 26 is fixed in the opening of the clamp support 23 and located on the left side and the right side of the rotary disc 25.

The rotatable clamping roller 27 is arranged at the other end of the connecting rod 212 and is used for pressing against the yarn around the yarn disc 22.

Figure 3:
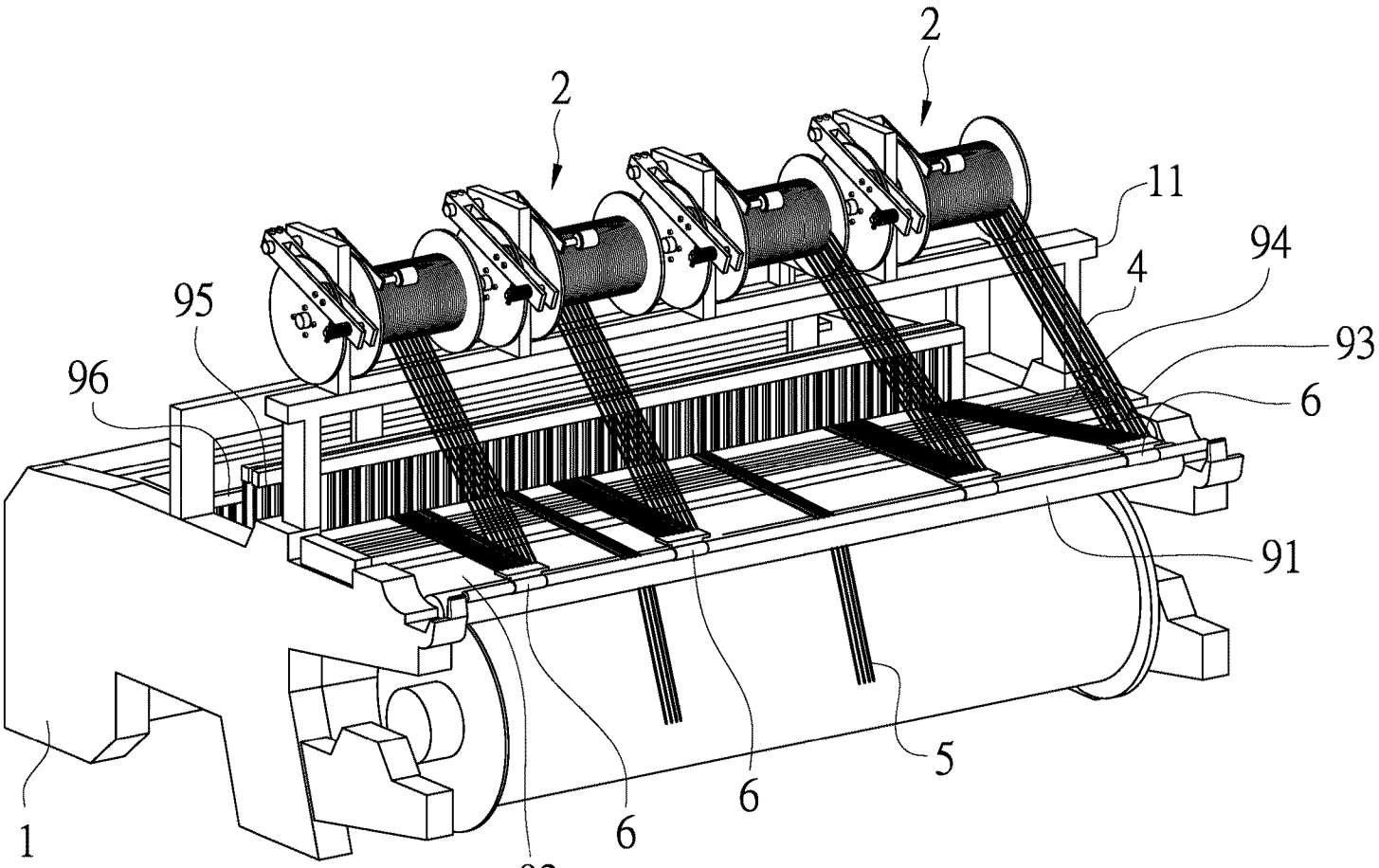
FIG. 3 is a schematic drawing showing embodiments of the present invention being disposed on a rapier loom with a warp beam according to the present invention.
Figure 4:
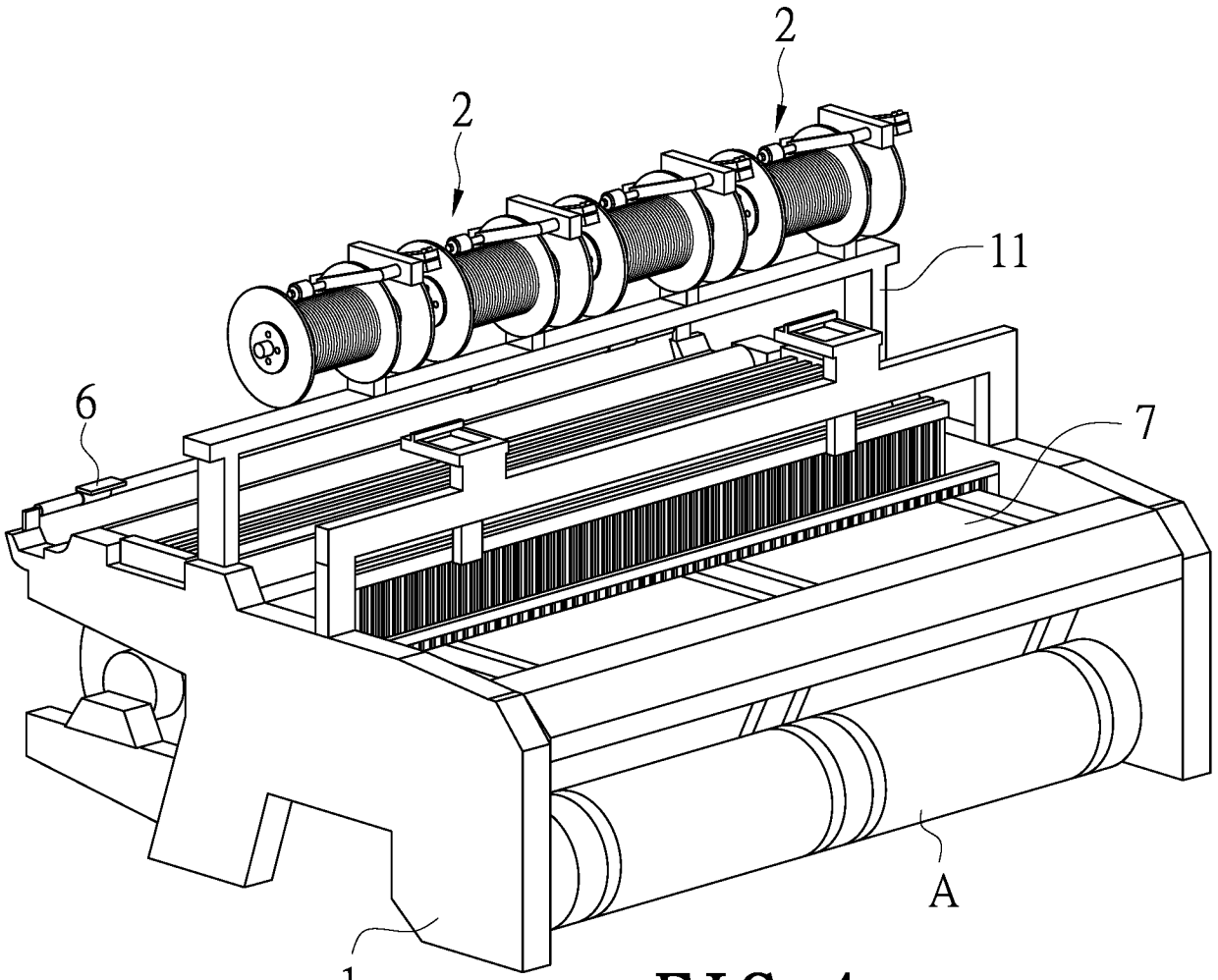
FIG. 4 is a schematic drawing showing embodiments of the present invention being disposed on a rapier loom with a cloth roller according to the present invention.
Figure 5:
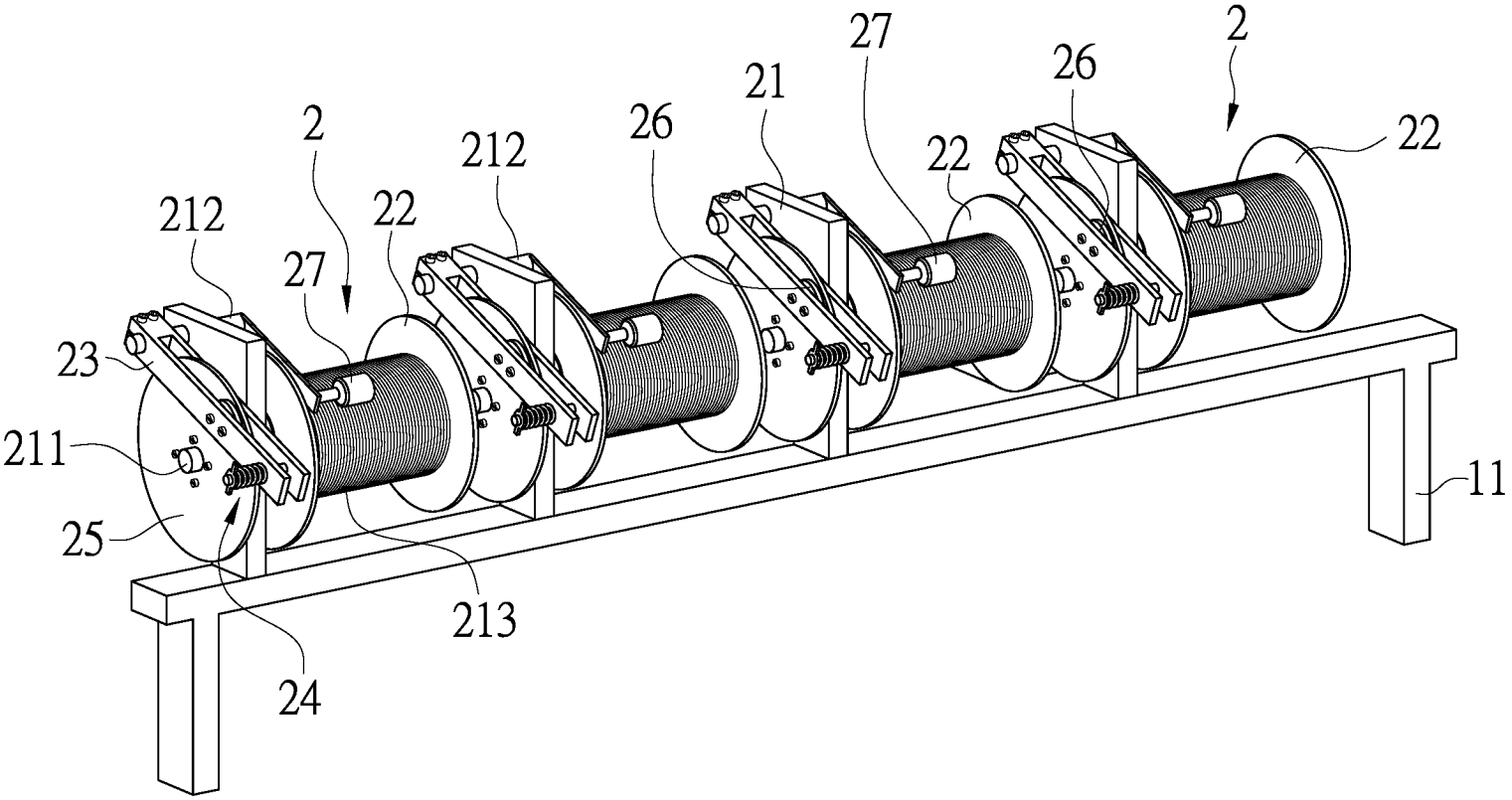
FIG. 5 is a perspective view of a plurality of embodiments disposed on a frame of a knitting machine according to the present invention.
Figure 6:
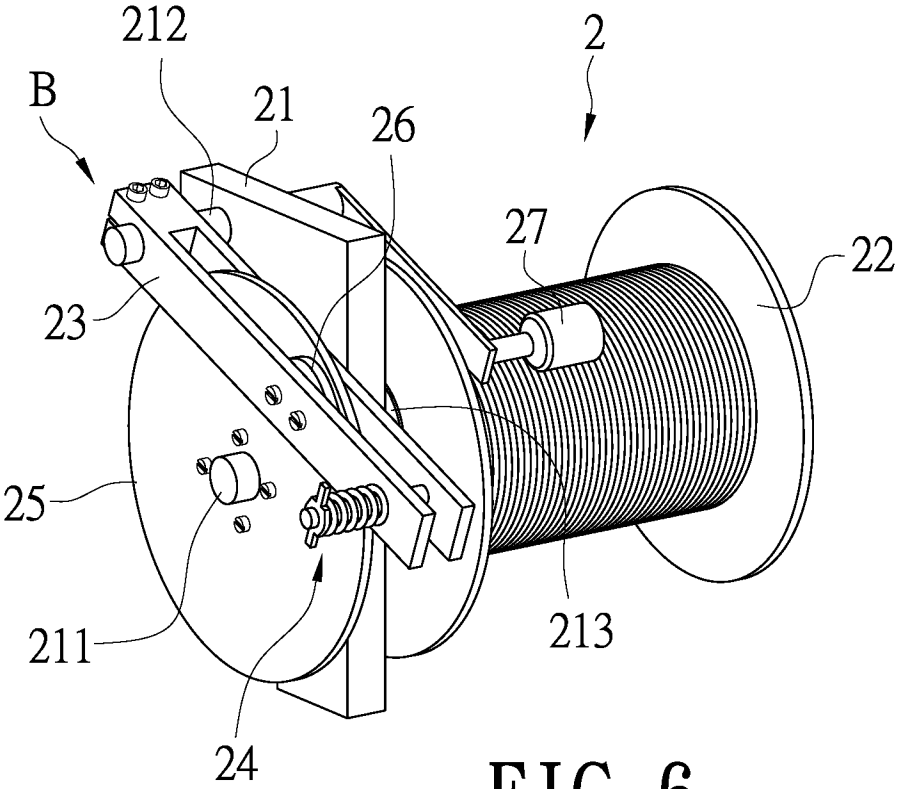
FIG. 6 is a perspective view of an embodiment according to the present invention.
Figure 7:
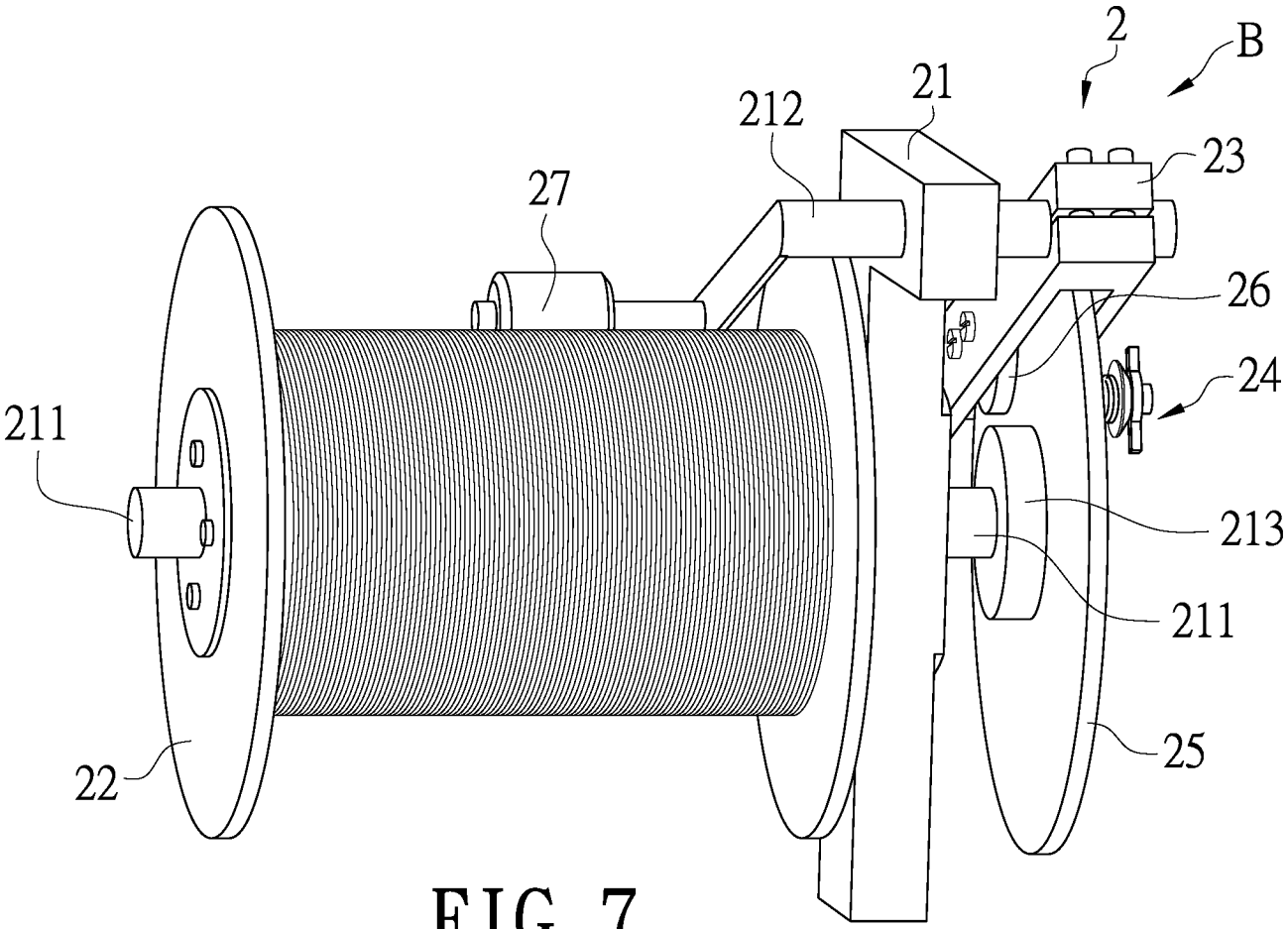
FIG. 7 is a perspective view of an embodiment viewed from another angle according to the present invention.

Refer to FIG. 3, FIG. 4 and FIG. 5, a plurality of yarn tension control devices 2 is installed on a frame 11 of the knitting machine 1 (the conventional rapier loom shown in FIG. 3 and FIG. 4) while in use. The yarn 22 of the yarn disc 22 includes metal yarns 4 or textile yarns 5. After being passed through a guide holder 6, bars for drop wires 93 and drop wires 94, the metal yarns 4 are entered steel healds 95. At the same time, general textile yarns 5 on a warp beam 10 are also passed through a guide bar 91, a back rest sensing roller 92, the bars for drop wires 93, the drop wires 94 and entered the steel healds 95. Then the metal yarns 4 and textile yarns 5 are passed through different reeds 96 respectively. After being weaved with weft yarns 7, blended fabric A formed by the metal yarns 4 and the textile yarns 5 is obtained.

Refer from FIG. 6 to FIG. 11, a bearing 3 is mounted in the main support 21 of the yarn tension control device 2. After the main shaft 211 being passed through the bearing 3, one end of the main shaft 211 is set with the fixing base 213 and the yarn disc 22 while the other end of the main shaft 211 is arranged with the rotary disc 25 so as to form a linked rotating mechanism. Then the clamping roller 27 is connected to one end of the connecting rod 212 and another bearing 3 is mounted in the clamping roller 27 so as to form the rotatable clamping roller 27 that is pressed against the yarns on the yarn disc 22 (including the metal yarns 4 and the textile yarns 5).

Figure 8:
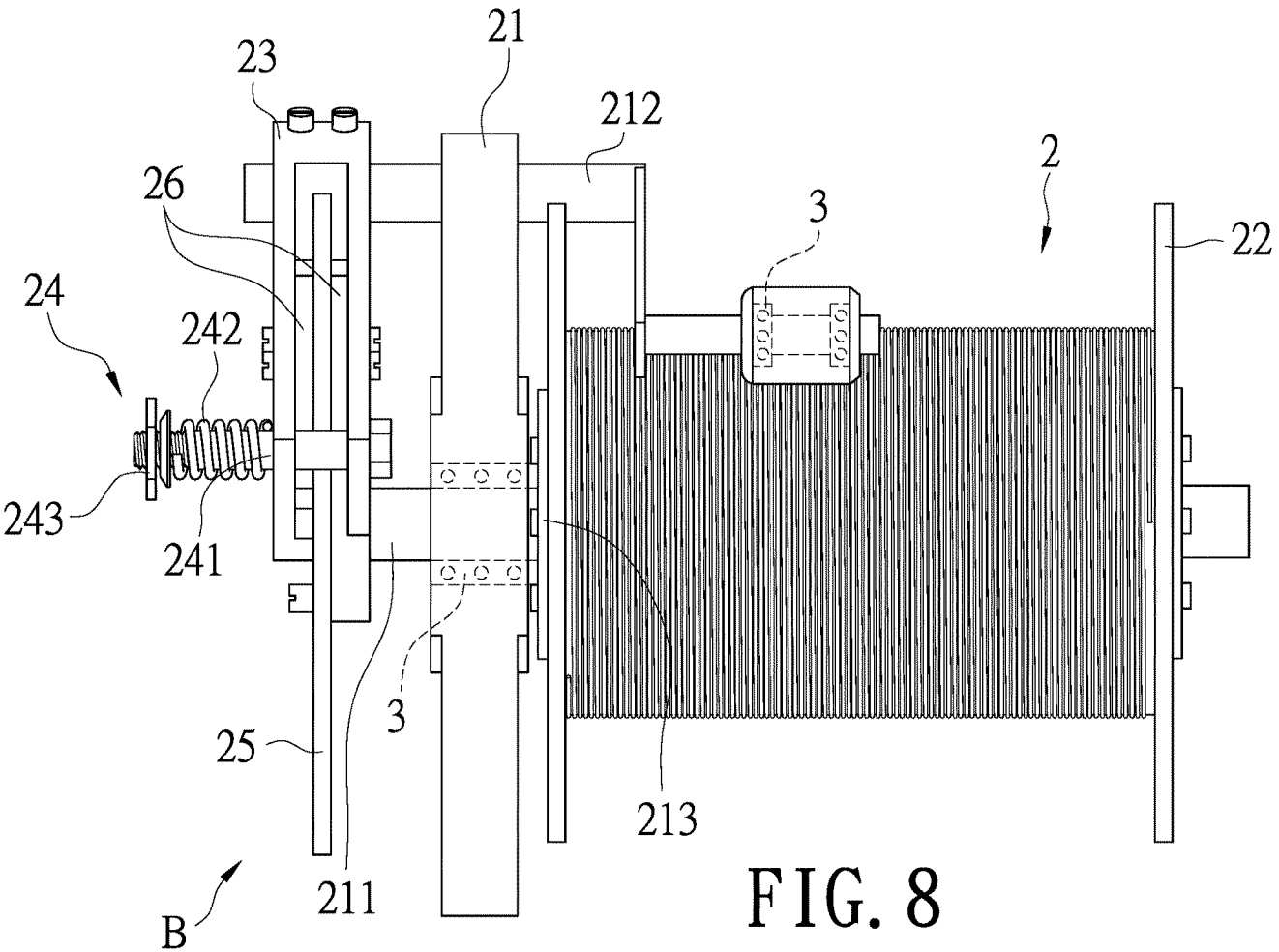
FIG. 8 is a front side view of an embodiment according to the present invention.
Figure 9:
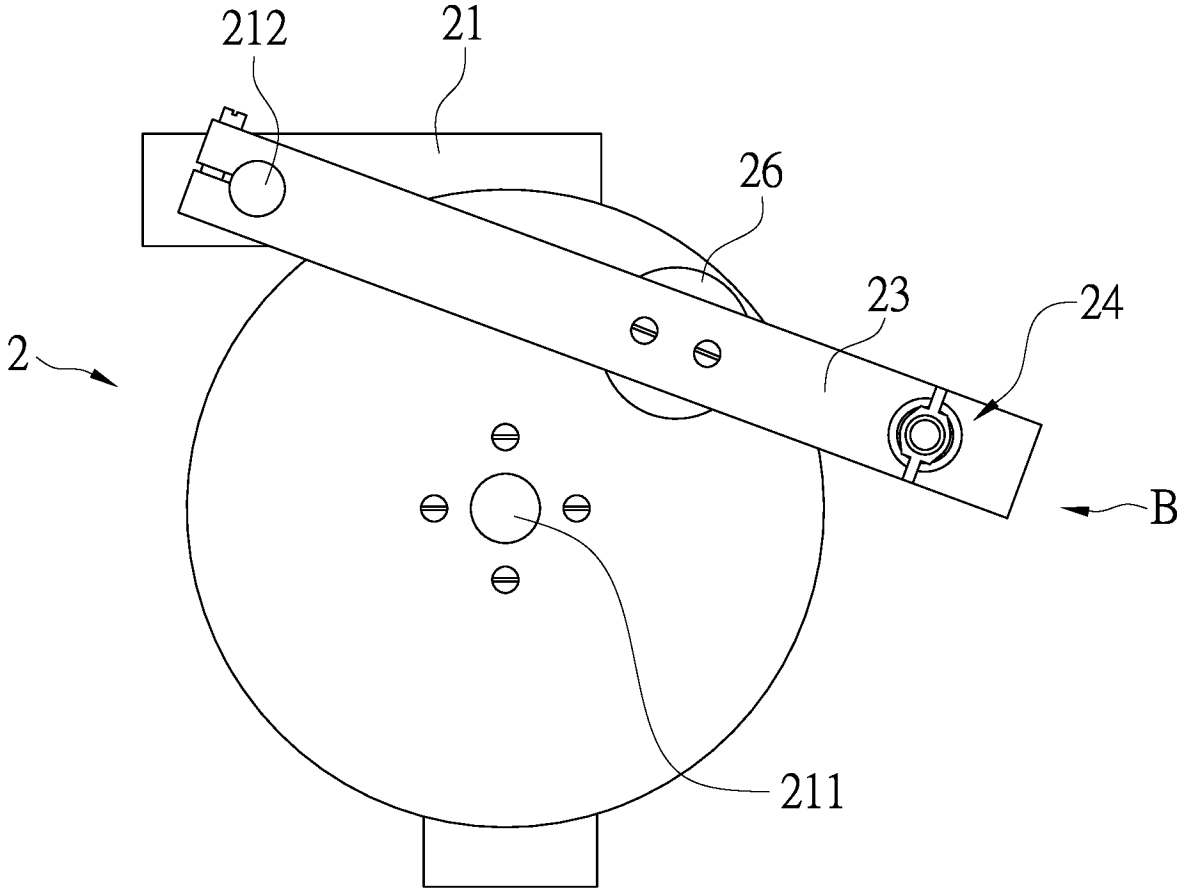
FIG. 9 is a left side view of an embodiment according to the present invention.
Figure 10:
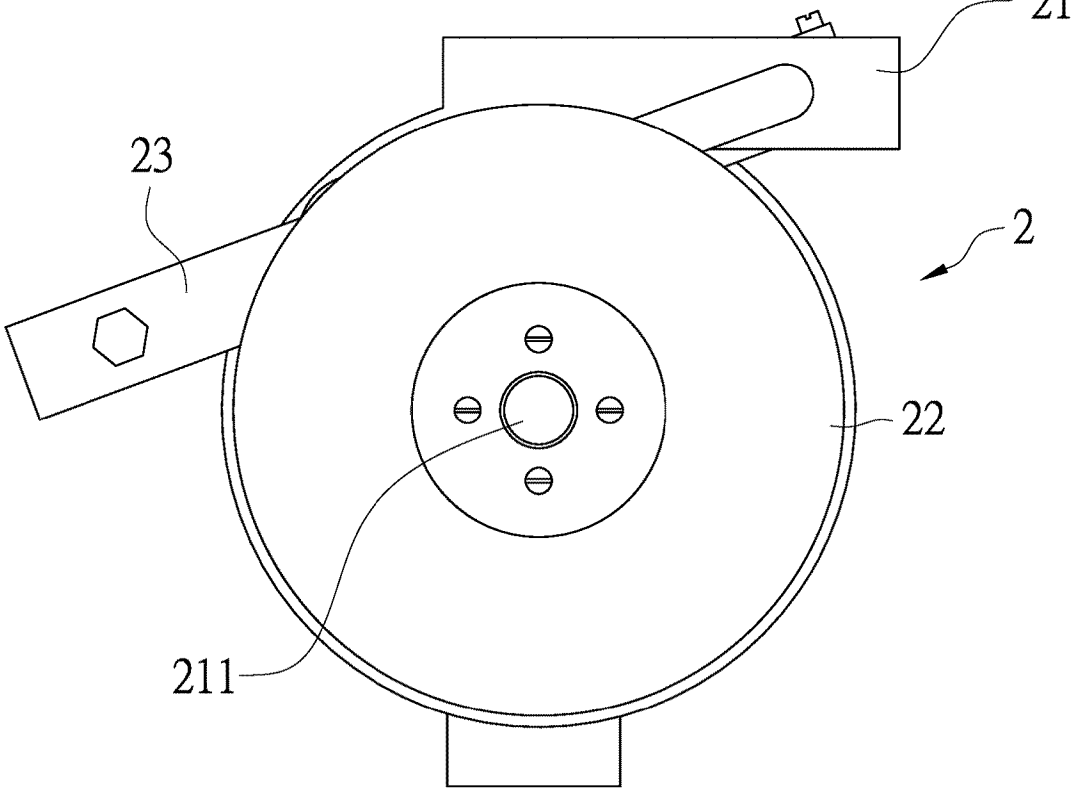
FIG. 10 is a right side view of an embodiment according to the present invention.
Figure 11:
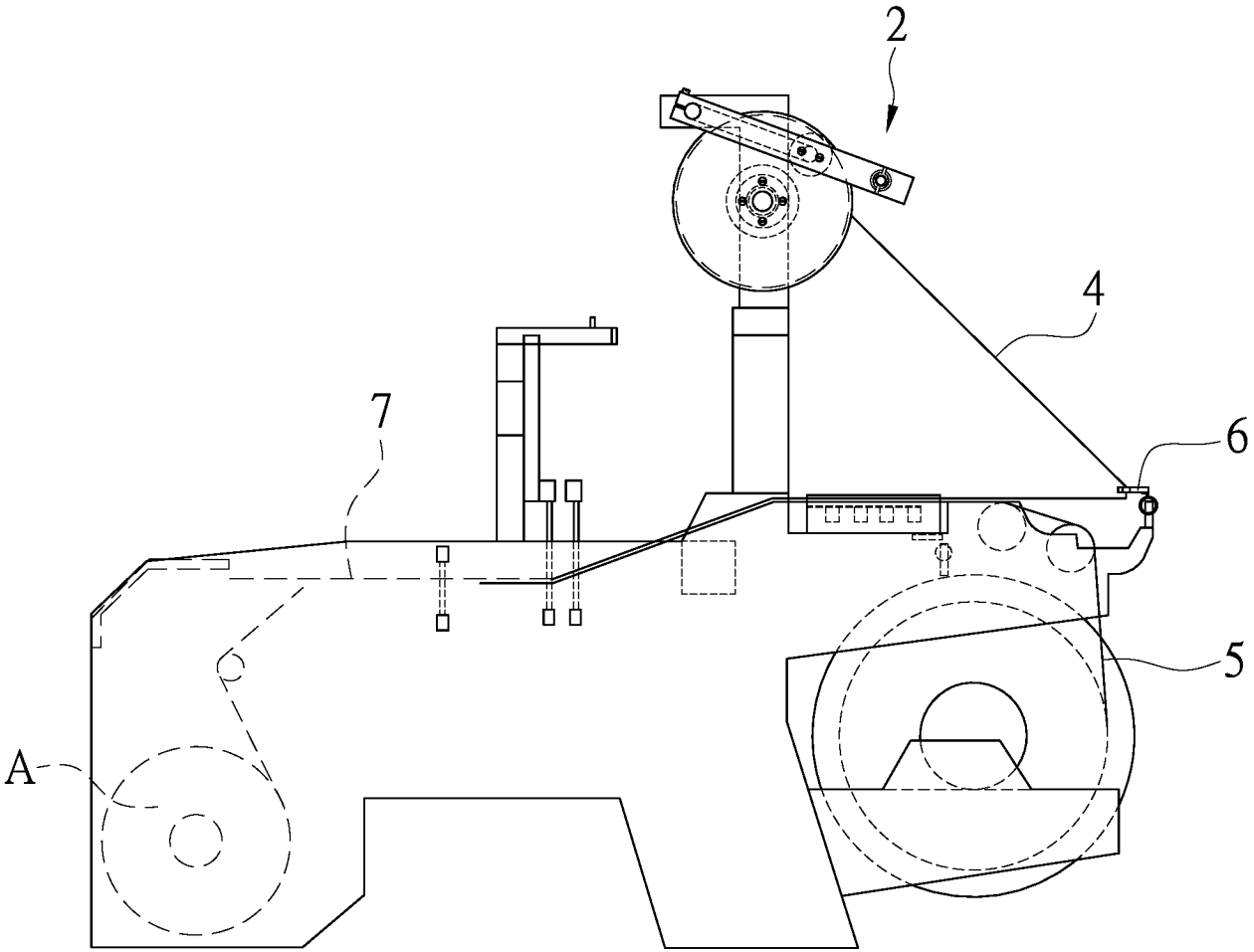
FIG. 11 is a schematic drawing showing a side view of a rapier loom disposed with embodiments according to the present invention.

The other end of the connecting rod 212 on the main support 21 is set with the clamp support 23. The clamp support 23 is a C-shaped piece with an opening while the rotary disc 25 is located in the opening of the clamp support 23 and the rubber set 26 corresponding to the rotary disc 25 is disposed on the clamp support 23. The rubber set 26 is fixed in the opening of the clamp support 23 and located on the left side and the right side of the rotary disc 25. Then a rear end of an opening of the clamp support 23 is arranged with the adjustment switch 24. As shown in FIG. 8, the adjustment switch 24 consists of a rod 241, a spring 242 and a knob 243. The rod 241 is passed through the opening of the clamp support 23 and the spring 242 is set around the rod 241 while the knob 243 is fastened on a rear end of the rod 241 for adjustment of friction of the rubber set 26 with respect to the rotary disc 25. The rotational speed of the rotary disc 25 is affected by the rubber set 26. Thus the magnitude of the speed and the tension of the metal yarns 4 or the textile yarns 5 being drawn into the knitting machine 1 can be controlled.

The rubber set 26 has a two-piece structure. The tension of the yarns on the yarn disc 22 is increased when the knob 243 is turned for adjustment of the tension of the spring 242 and the two-piece rubber set 26 clips the rotary disc 25 more tightly. On the other hand, the tension of the yarns is reduced while the rotary disc 25 is clamped less tightly. Thus users can turn the knob 243 for adjustment of the yarn tension according to their requirements on production.

Figure 12:
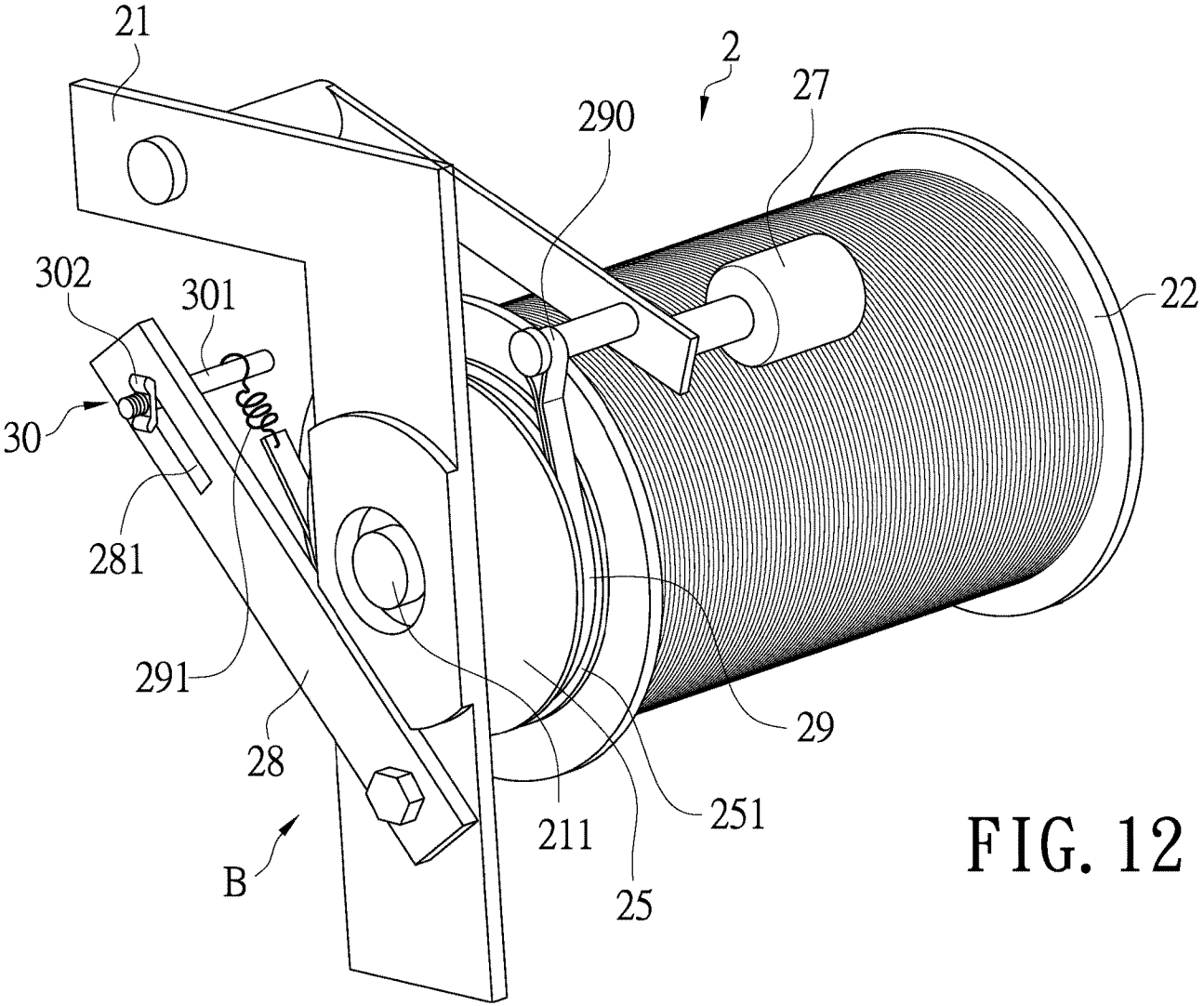
FIG. 12 is a perspective view of another embodiment according to the present invention.
Figure 13:
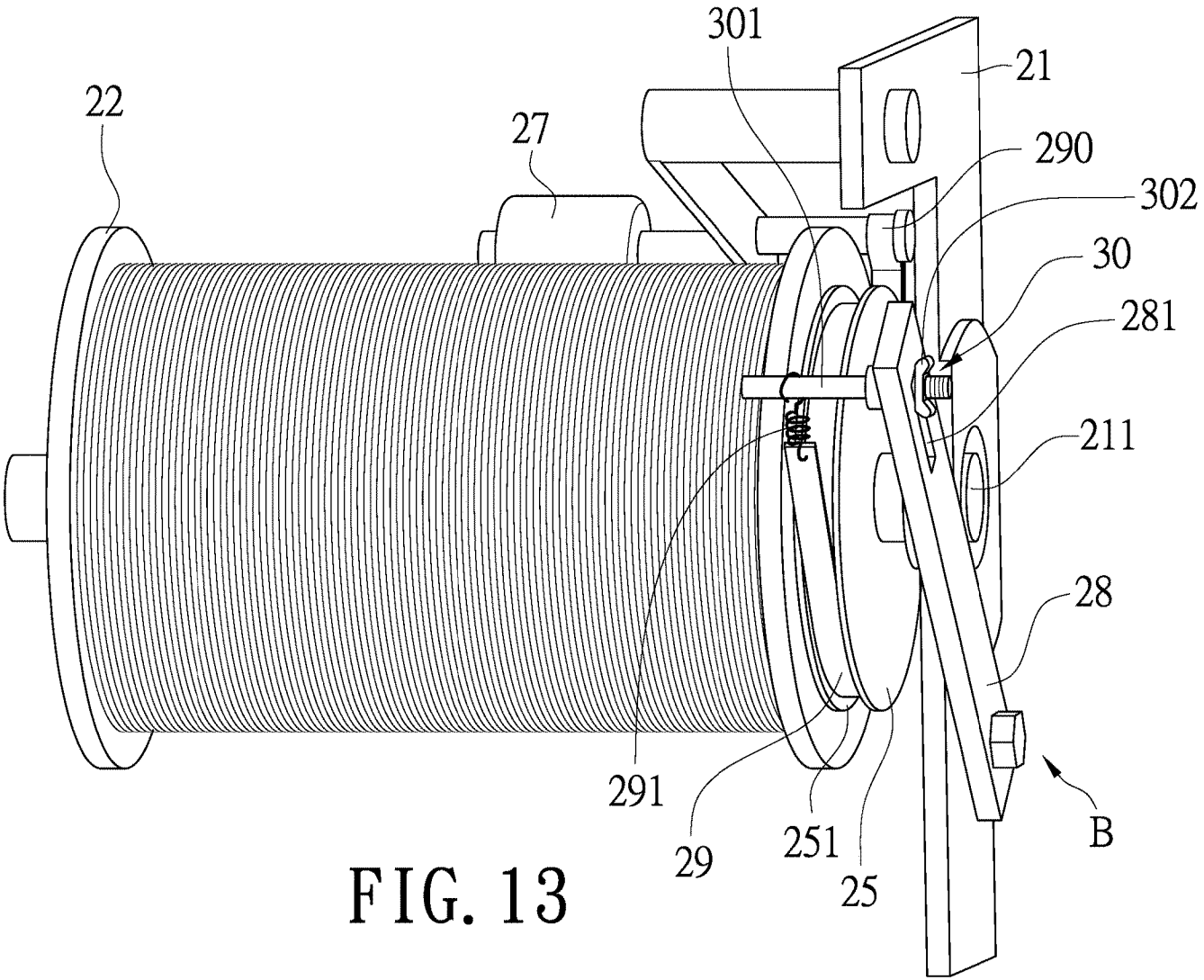
FIG. 13 is a perspective view of another embodiment viewed from another angle according to the present invention.

Moreover, besides the tightness of the rubber set 26, the rotational speed of the rotary disc 25 can also be affected by other factors. Refer to FIG. 12 and FIG. 13, another embodiment of the present invention is revealed. In this embodiment, a yarn tension control device 2 includes a main support 21, a yarn disc 22, a rotary disc 25, a rubber set and a clamping roller 27.

The main support 21 is a base installed over the knitting machine 1 and a main shaft 211 is passed therethrough.

The yarn disc 22 is fit on the main shaft 211 and is wound with yarns.

The rotary disc 25 is arranged at the main shaft 211, and located on one side of the yarn disc 22. A guide groove 251 is disposed around the circumference of the rotary disc 25.

The rubber set is located on one side of the rotary disc 25 and having a support fixing member 28 and a belt 29. The support fixing member 28 including a guide slot 281 is set on one end of the main support 21 while an adjusting rod set 30 is passed through the guide slot 281 and is moveable in the guide slot 281. The belt 29 is mounted in the guide groove 251 and wound around the rotary disc 25. One end of the belt 29 is a fixed end 290 while the other end thereof is disposed with a hook spring 291 being hooked to the adjusting rod set 30. The friction of the belt 29 in relation to the rotary disc 25 can be adjusted by displacement of the adjusting rod set 30.

The clamping roller 27 is rotatable and is arranged at the main support 21 for pressing against yarns around the yarn disc 22.

Refer to FIG. 12 and FIG. 13, this embodiment is disposed on a knitting machine in a similar way as the embodiment mentioned above. The difference between this embodiment and the above one is in that friction damping is from the belt in this embodiment. In both embodiments, the main support 21 is arranged with a bearing 3 therein. The main shaft 211 is disposed with the yarn disc 22 and the rotary disc 25 respectively after being passed through the main support 21 to form a linked rotating mechanism. Then another bearing 3 is mounted in the clamping roller 27 so that the clamping roller 27 is rotatable and able to press against the yarns on the yarn disc 22. The yarns can be metal yarns 4 or textile yarns 5.

Next the support fixing member 28 of the rubber set is fastened and fixed on the main support 21. The adjusting rod set 30 is passed through the guide slot 281 of the support fixing member 28. The adjusting rod set 30 consists of an adjusting bolt 301 and a locking nut 302. The position of the adjusting bolt 301 in the guide slot 281 is fixed by the locking nut 302 after being inserted through the guide slot 281 and being adjusted properly. One end of the belt 29 is a fixed end 290 that is fixed on the main support 21 or is positioned at a rod which the clamping roller 27 is disposed on. Later the belt 29 is mounted in the guide groove 251 and wound around the rotary disc 25. As to the hook spring 291 on the other end of the belt 29, it is hooked onto the adjusting rod set 30. Thus friction damping that works on the rotary disc 25 is generated by the belt 29.

The further the adjusting bolt 301 is away from a fixed end on top of the guide slot 281, the tighter and closer the belt 29 is clamped while the adjusting bolt 301 being adjusted and moved in the guide slot 281. That means the larger the yarn tension of the yarns on the yarn disc 22. On the other hand, the looser the belt 29, the smaller the yarn tension is. Users can adjust the adjusting rod set 30 according to their own requirements on production.

Figure 14:
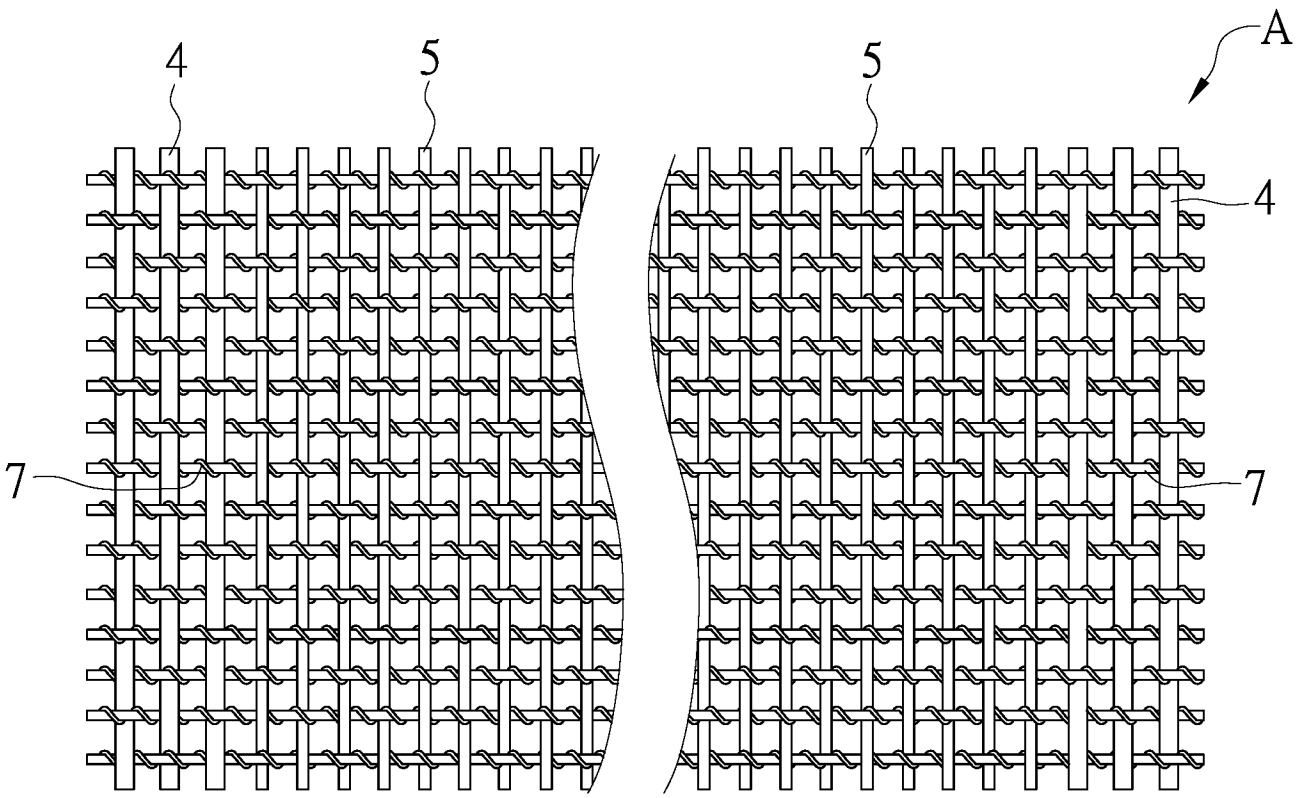
FIG. 14 is a perspective view of fabric produced by a knitting machine disposed with an embodiment according to the present invention.

Refer to FIG. 14, the present yarn tension control device is suitable to be applied to fabric A made from the textile yarns 5. The fabric edge on each of two sides of the fabric A is woven with a plurality of the metal yarns 4 that are metal yarns or non-conductive metal yarns. The fabric A produced can be conductive heating fabric, electromagnetic shielding fabric or radar absorbent fabric.

The present yarn tension control device 2 can also be used to weave the textile yarns 5 for control of tension of the textile yarns 5 being drawn. During knitting, a plurality of textile yarns 5 is weaved on edges of two sides of the fabric surface and used as scrap yarns. The textile yarns 5 can be pure yarns or blended yarns.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A yarn tension control device for use on a knitting machine, comprising:

a main support installed over the knitting machine and being inserted with a main shaft;

a yarn disc wound with yarns and disposed on the main shaft;

a rotary disc arranged at the main shaft;

a rotatable clamping roller disposed on the main support and used for pressing against the yarns of the yarn disc; and a friction damper arranged at one side of the rotary disc and used to control and adjust rotational speed of the rotary disc;

wherein a plurality of the yarn tension control devices is disposed on the knitting machine while in use; the yarn disc and the rotary disc are disposed on the main shaft and are rotated at the same speed along with the yarns being drawn by an external force;

wherein the main support is a base installed over the knitting machine; a connecting rod is passed through and disposed on the main support; a fixing base is disposed on one end of the main shaft; the yarn disc is fit on the fixing base; the rotary disc is arranged at another end of the main shaft and located on one side of the main support; the friction damper includes a clamp support and a rubber set; the clamp support is disposed on one end of the connecting rod and the rotary disc being passed through an opening of the clamp support and an adjustment switch is arranged at a rear end of the opening of the clamp support; the rubber set is fixed in the opening of the clamp support and located on a left side and a right side of the rotary disc; friction of the rubber set with respect to the rotary disc is adjusted by the adjustment switch; the rotatable clamping roller is disposed on another end of the connecting rod.

2. The device as claimed in claim 1, wherein the rotary disc is located on one side of the yarn disc and a guide groove is disposed therearound; the friction damper includes a support fixing member and a belt; the support fixing member having a guide slot and being set on one end of the main support while an adjusting rod set is passed through the guide slot and is moveable in the guide slot; the belt is mounted in the guide groove and wound around the rotary disc; one end of the belt is a fixed end while another end thereof is disposed with a hook spring being hooked to the adjusting rod set; friction of the belt in relation to the rotary disc is adjustable by displacement of the adjusting rod set.

3. The device as claimed in claim 1, wherein a frame is disposed over the knitting machine and the plurality of the yarn tension control devices are set on the frame of the knitting machine.

4. The device as claimed in claim 1, wherein a bearing is disposed between the main support and the main shaft as well as in the clamping roller.

5. The device as claimed in claim 1, wherein the adjustment switch includes a rod passed through the opening of the clamp support, a spring set around the rod, and a knob fastened on a rear end of the rod for adjustment of tension of the spring and further adjustment of the friction of the rubber set on the clamp support with respect to the rotary disc.

6. The device as claimed in claim 2, wherein the adjusting rod set includes an adjusting bolt and a locking nut; the adjusting bolt is passed through and moveable in the guide slot; the locking nut is fastened on the adjusting bolt and used for positioning the adjusting bolt in the guide slot.

7. The device as claimed in claim 2, wherein a frame is disposed over the knitting machine and the plurality of the yarn tension control devices are set on the frame of the knitting machine.

8. The device as claimed in claim 2, wherein a bearing is disposed between the main support and the main shaft as well as in the clamping roller.

9. A yarn tension control device for use on a knitting machine, comprising:

a main support installed over the knitting machine and being inserted with a main shaft;

a yarn disc wound with yarns and disposed on the main shaft;

a rotary disc arranged at the main shaft;

a rotatable clamping roller disposed on the main support and used for pressing against the yarns of the yarn disc; and a friction damper arranged at one side of the rotary disc and used to control and adjust rotational speed of the rotary disc;

wherein a plurality of the yarn tension control devices is disposed on the knitting machine while in use; the yarn disc and the rotary disc are disposed on the main shaft and are rotated at the same speed along with the yarns being drawn by an external force;

wherein the main support is a base installed over the knitting machine; the rotary disc is located on one side of the yarn disc and a guide groove is disposed therearound; the friction damper includes a support fixing member and a belt; the support fixing member having a guide slot and being set on one end of the main support while an adjusting rod set is passed through the guide slot and is moveable in the guide slot; the belt is mounted in the guide groove and wound around the rotary disc; one end of the belt is a fixed end while another end thereof is disposed with a hook spring being hooked to the adjusting rod set; friction of the belt in relation to the rotary disc is adjustable by displacement of the adjusting rod set.

10. The device as claimed in claim 9, wherein the adjusting rod set includes an adjusting bolt and a locking nut; the adjusting bolt is passed through and moveable in the guide slot; the locking nut is fastened on the adjusting bolt and used for positioning the adjusting bolt in the guide slot.

11. The device as claimed in claim 9, wherein a frame is disposed over the knitting machine and the plurality of the yarn tension control devices are set on the frame of the knitting machine.

12. The device as claimed in claim 9, wherein a bearing is disposed between the main support and the main shaft as well as in the clamping roller.

* * * * *